United States Patent [19]

Cross

[11] 4,097,109

[45] Jun. 27, 1978

[54] ACCESSORY ELECTRICAL CONNECTOR

[75] Inventor: William E. Cross, Brookfield, Ohio

[73] Assignee: General Motors Corporation, Detroit, Mich.

[21] Appl. No.: 810,409

[22] Filed: Jun. 27, 1977

[51] Int. Cl.[2] ..... H01R 13/12; H01R 19/40

[52] U.S. Cl. ..... 339/147 R; 339/176 R; 339/198 S; 339/258 F

[58] Field of Search ..... 339/59 R, 59 M, 125 R, 339/126 R, 147 R, 147 P, 150 R, 150 F, 150 T, 151 R, 151 M, 176 R, 176 M, 198 R, 198 S, 198 P, 198 N, 256 C, 258 F, 262 F; 337/186–189

[56] References Cited

U.S. PATENT DOCUMENTS 2,955,178 10/1960 Lander et al. ..... 337/188

3,412,368 11/1968 Asbridge et al. ..... 339/126 R 3,478,307 11/1969 Testo ..... 339/258 F

*Primary Examiner*—Neil Abrams

*Attorney, Agent, or Firm*—F. J. Fodale

[57] ABSTRACT

An accessory electrical connector comprises an accessory terminal attached to the end of an electrical lead and retained in the cavity of a connector body with the lead extending back through a front opening. The accessory electrical connector is plugged into a cavity of a terminal block through a front opening where the contact portion of the accessory terminal is laterally spaced from an available power terminal in the terminal block. A circuit breaker or the like is then plugged into the two terminals to provide electrical continuity through the terminal block.

4 Claims, 6 Drawing Figures

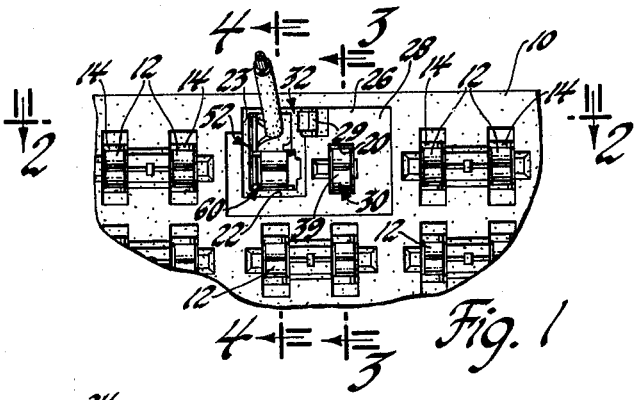
Fig. 1
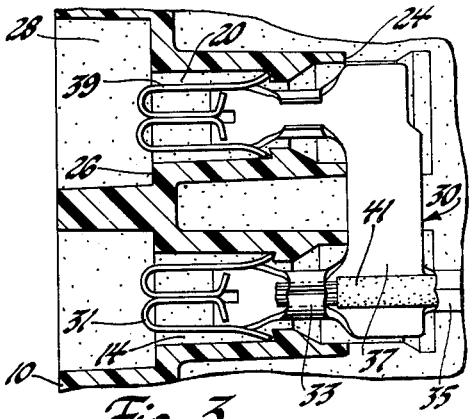
Fig. 3
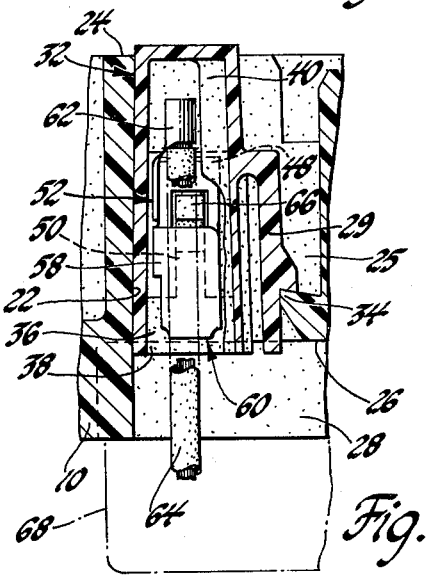
Fig. 2
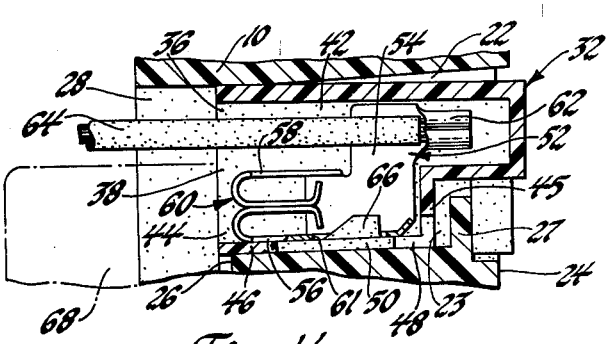
Fig. 4
Fig. 5
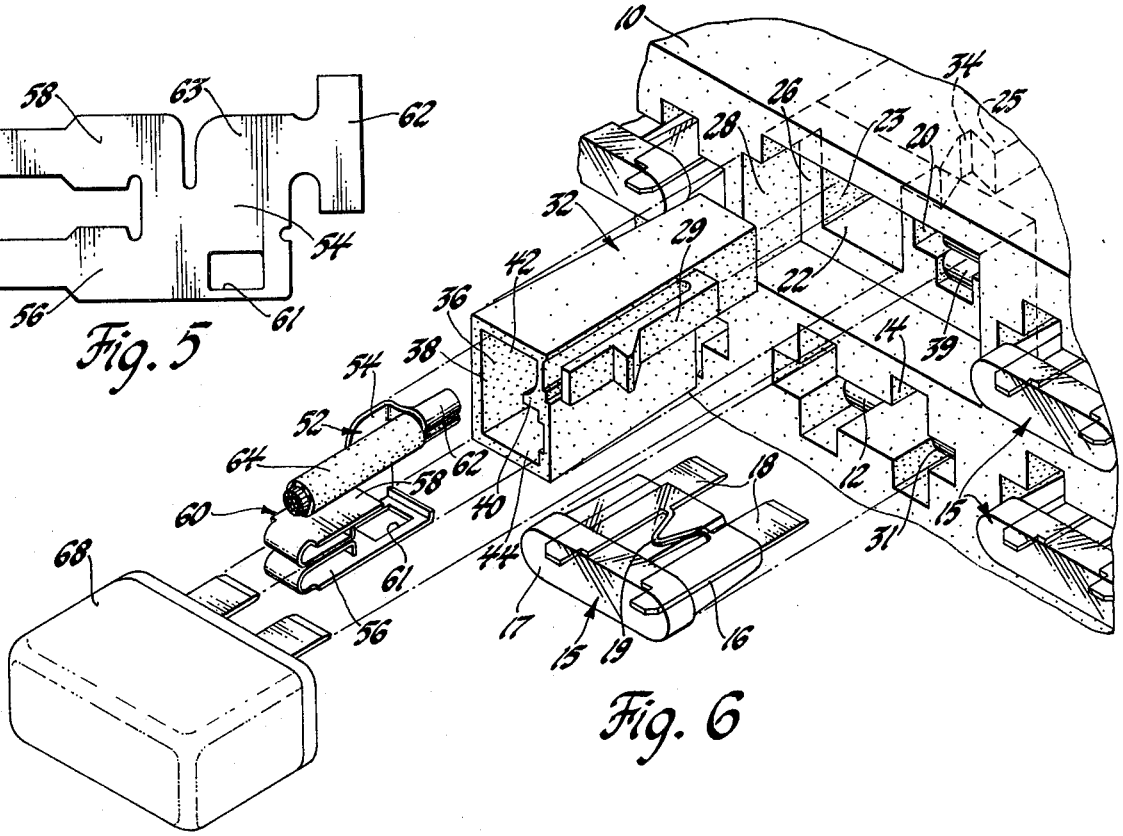
Fig. 6

ACCESSORY ELECTRICAL CONNECTOR

This invention relates to electrical connectors and more particularly to an accessory electrical connector which can be plugged into a terminal block.

By way of background, electrical systems for automobiles generally include a terminal block which is customarily mounted on the fire wall below the instrument panel in the passenger compartment. This places the terminal block in a convenient accessible location so that several electrical components such as circuit breakers and fuses can be plugged into the terminal block to complete various electrical circuits and thereafter be readily replaced should the need arise. Today automobiles offer many customer selected options such as power windows, power seats and the like. The electrical systems for these options often require replaceable components such as fuses and circuit breakers.

The object of this invention is to provide for the addition of such customer selected options to the electrical system of the automobile in a manner which utilizes the conveniently located terminal block but which does not require removal of the terminal block.

More specifically the invention contemplates an accessory electrical connector which can be readily attached to one of the electrical leads of the selected option and plugged into the front of the already mounted terminal block to provide part of a receptacle for a circuit breaker, fuse or other replaceable component which provides circuit continuity through the terminal block.

Other objects and features of the invention will become apparent to those skilled in the art as the disclosure is made in the following detailed description of a preferred embodiment of the invention as illustrated in the accompanying sheet of drawing in which:

FIG. 1 is a fragmentary front view of a terminal block having an accessory electrical connector in accordance with this invention, FIG. 2 is a horizontal section taken substantially along the line 2—2 of FIG. 1 and looking in the direction of the arrows, FIG. 3 is a vertical section taken substantially along the line 3—3 of FIG. 1 and looking in the direction of the arrows, FIG. 4 is a vertical section taken substantially along the line 4—4 of FIG. 1 and looking in the direction of the arrows, FIG. 5 is a plan view of the sheet metal blank for the female accessory terminal used in the accessory electrical connector, and FIG. 6 is an exploded perspective view showing the terminal block portion and accessory electrical connector shown in FIGS. 1-4, a circuit breaker and a number of fuses.

Referring now to FIG. 1 there is shown a portion of a terminal block 10. Such a terminal block is customarily mounted on the fire wall of an automobile below the instrument panel. Prior to mounting, the terminal block is fed by a wiring harness having several electrical leads with attached terminals 12 (usually female) which are inserted into the rear open ends of several terminal cavities 14 extending through the block and retained in the cavities 14 usually by a spring finger of the terminal engaging a cooperating latch shoulder in the cavity. When mounted the terminal block is then relatively accessible for plugging various electrical components into the automotive electrical system. The most common component is a fuse and the particular terminal block illustrated herein is adapted to receive flat fuses 15 comprising a flat sheet metal stamping 16 partially disposed in a plastic housing 17. The stamping 16 includes a fuse element 19, and a pair of laterally spaced protruding male blades 18 which are plugged into a pair of female terminals 12 disposed in adjacent cavities of the terminal block.

This invention is directed toward an accessory electrical connector which can be plugged into the front of the mounted terminal block and thereafter form part of a receptacle for a circuit breaker, fuse or other electrical device. The terminal block is adapted to receive the accessory connector as well as provide the other part of the receptacle.

More specifically the terminal block 10 includes a special set of cavities 20 and 22 which extend through the terminal block 10 from the rear face 24 to a forward face 26 of a specially configured recess 28.

The cavity 20 is similar to the other cavities of the terminal block 10 in that (1) it receives and retains a female terminal attached to an electrical lead which is inserted into a rear opening and (2) the terminal is disposed in the cavity prior to the terminal block being mounted on the fire wall. In this particular instance, however, a special dual terminal 30 for two cavities is utilized. More particularly the dual terminal 30 comprises a female terminal portion 31 of the type which is generally disclosed in the U.S. Pat. No. 3,267,410 granted to Donald G. Baer et al. on Aug. 16, 1966. A major modification, however, is that the core crimp wings 33 and the insulation crimp wings 35 are spread apart longitudinally to incorporate an integral, transversely extending bus bar portion 37 which carries a second female contact portion 39. The lead 41 is preferably a power lead in which event the mounted terminal block 10 has a power source for any of a number of optional electrical accessories which a customer might select.

Of course, the dual terminal 30 can be replaced by separate terminals with individual leads depending on the electrical circuitry involved. On the other hand, the female terminals 12 in any particular vertical row might be replaced by dual (or treble, quadruple, etc.) terminals if the circuitry permits it.

When the terminal block 10 is mounted on the fire wall, the larger cavity 22 is empty and adapted to receive and retain an electrical accessory connector inserted or plugged into its front opening. More particularly the cavity 22 comprises a generally rectangular portion 23 conforming to the shape of the accessory connector body 32 and a narrow lateral portion 25. The rectangular portion 23 has a partial rear wall 27 which forms a stop limiting insertion of the connector body 32 forming part of the accessory electrical connector. The lateral portion 25 of the cavity 22 is shaped for receiving an integral latch arm 29 of the connector body 32 and includes a ramped latch shoulder 34 for retaining the connector body 32 in the cavity 22.

The connector body 32 conforms to the shape of the cavity portion 23. It in turn has a longitudinal cavity 36 which is generally rectangular in cross section and which has a front opening 38. The cavity 36 is divided by a longitudinal rib 40 into a lead receiving portion 42 and a shorter contact receiving portion 44. The lead receiving portion 42 has a full rear wall and is thus completely closed except for the front opening 38. The contact receiving portion 44 has a partial rear wall 45 which provides a stop limiting insertion of the accessory terminal 52. The rearward portion of the connector body side wall 46 partially defining the contact receiving portion 44 of the cavity 36 has a U-shaped slot 48 which defines a cantilevered latch finger 50 for retaining the accessory terminal 52 in the cavity 36.

The accessory terminal 52 is a unitary sheet metal member comprising a generally flat L-shaped body portion 54. A first transverse flange portion 56 is connected to the longest longitudinal edge of the body portion and a second shorter flange portion 58 is connected to the closer of the remaining longitudinal edges. Flanges 56 and 58 project forwardly of the body in the longitudinal direction and then reverse direction to provide two cantilevered U-shaped fingers which form a female contact portion 60 adapted to receive and biasingly engage a male terminal blade. The free ends of the fingers have upright tabs which engage the flanges to limit the spread of the confronting portions of the U-shaped fingers. The rearward portion of the flange 58 has a rectangular hole 61. A lead attachment portion 62 comprising a pair of crimp wings is connected to the body portion 54 at a location spaced transversely from the contact portion 60 and extends in the opposite longitudinal direction. The transverse spacing permits an electrical lead 64 of the optional accessory (not shown) to be attached to the accessory terminal 52 so that the lead 64 extends from the attachment portion 62 in the same longitudinal direction as the contact portion 60, that is toward the left as viewed in FIGS. 4 and 6. The electrical lead 64 is otherwise conventionally attached to the accessory terminal 52 by crimping the wings about a bared conductor portion at one end of the lead. The shape of the accessory terminal 52 and attachment arrangement permits the accessory terminal 52 and lead 64 to be inserted into the front opening of the cavity 36 of the connector body 32 via the front opening 38. The extension of the contact portion 60 and the attachment portion 62 in opposite longitudinal directions optimizes material savings as evidenced by the terminal blank 63 shown in FIG. 5.

During assembly the rib 40 serves as a guide to direct the attachment potion 62 and the contact portion 60 into their respective portions of the cavity 36. The terminal 52 is locked in the connector body cavity 36 by the locking ramp 66 on the latch finger 50. The accessory terminal 52 and connector body 32 is preferably attached to the accessory lead 64 at the factory to form an electrical connector for the accessory.

When the optional electrical accessory is selected by the customer it is simply conveniently mounted on a support in the passenger compartment and the connector body 32 is simply plugged into the empty cavity 22 of the terminal block 10 and locked therein by the latch arm 29. This places the contact portion 60 of the accessory terminal 52 in lateral alignment with the contact portion 39 of the dual power terminal 30. Next an electrical device providing circuit continuity such as a circuit breaker 68 having a pair of laterally spaced male blade terminals is plugged into the laterally aligned accessory and power terminals. This establishes a power source containing a circuit breaker to the optional electrical accessory and the other accessory lead can simply be taken to ground. It should be noted that the recess 28 is shaped to accommodate the end portion of the circuit breaker 68 and is also large enough to accept the flat fuse 15. Of course other electrical devices might also be plugged in.

I wish it to be understood that I do not desire to be limited to the exact details of construction shown and described, for obvious modifications will occur to a person skilled in the art.

What is claimed is:

1. An electrical accessory connector for a mounted terminal block having a front opening cavity adjacent an available terminal carried by the mounted terminal block comprising:

a connector body insertable into the front opening cavity of the terminal block, said connector body having a longitudinal cavity having a front opening, an accessory terminal which is shaped for insertion into the longitudinal cavity via the front opening, said accessory terminal being disposed in the longitudinal cavity and having a body portion, a contact portion which extends from the body portion in a longitudinal direction toward the front opening and which is in lateral alignment with the available terminal when the connector body is disposed in the front opening cavity of the terminal block, and an attachment portion which is spaced from said contact portion in a transverse direction, and an electrical lead having one end mechanically and electrically secured to the accessory terminal by the attachment portion, said lead extending from the attachment portion in a longitudinal direction past said contact portion and out of the connector body cavity via the front opening whereby upon disposition of the connector body in the cavity of the terminal block, the accessory terminal and the available terminal are adapted to receive an electrical device to establish electrical continuity for the electrical lead through the terminal block.

2. An electrical accessory connector for a mounted terminal block having a front opening cavity adjacent an available contact portion of a preassembled terminal carried by the mounted terminal block comprising:

a connector body insertable into the front opening cavity of the terminal block, said connector body having a longitudinal cavity having a front opening, an accessory terminal which is shaped for insertion into the longitudinal cavity via the front opening, said accessory terminal being disposed in the longitudinal cavity and having a generally flat body portion, a contact portion which is connected to the body portion by flange means, which projects from the body portion in a longitudinal direction toward the front opening and which is in lateral alignment with the available contact portion of the preassembled terminal when the connector body is disposed in the front opening cavity of the terminal block, and an attachment portion connected to the body portion which is spaced from said contact portion in a transverse direction and which projects from the body portion in a longitudinal direction away from said front opening, and an electrical lead having one end mechanically and electrically secured to the accessory terminal by the attachment portion, said lead extending from the attachment portion in a longitudinal direction past said contact portion and out of the connector body cavity via the front opening whereby upon disposition of the connector body in the cavity of the terminal block, the contact portion of the accessory terminal and the available contact portion of the preassembled terminal are adapted to receive respective terminals of an electrical device to establish electrical continuity for the electrical lead through the terminal block.

3. An electrical accessory connector comprising:

a connector body having a longitudinal cavity having a front opening, said connector body having a longitudinal rib dividing said cavity into a contact receiving portion and a lead receiving portion, an accessory terminal which is shaped for insertion into the cavity via the front opening, said terminal being disposed and retained in the cavity and having a generally flat body portion, a contact portion which is connected to the body portion by flange means which extend laterally from the body portion, said contact portion extending forwardly of the body portion in a longitudinal direction toward the front opening, and an attachment portion which extends laterally from the body portion in the same direction as the flange means which projects from the body portion in a longitudinal direction away from said front opening, said attachment portion being spaced from said contact portion in a transverse direction, and an insulated electrical lead wire having an insulation stripped, exposed conductor at one end secured to the terminal by the attachment portion, said lead extending from the attachment portion in a longitudinal direction past said contact portion and out of the connector body cavity via the front opening.

4. The combination comprising:

a terminal block having a front face and a rear face, a first cavity extending through said terminal block and having front and rear openings at the front and rear faces respectively, and a second cavity adjacent the first cavity having a front opening at the front face of the terminal block, a first terminal disposed in said first cavity, said first terminal having a contact portion disposed adjacent the front opening of the first cavity and means adjacent the rear opening to connect the first terminal to an electrical lead disposed behind the rear face of the terminal block, an accessory connector body insertable into the second cavity via its front opening, said accessory connector body having a longitudinal cavity having a front opening, an accessory terminal which is shaped for insertion into the longitudinal cavity via the front opening of the accessory connector body, said accessory terminal being disposed in the longitudinal cavity and having a body portion, a contact portion which extends from the body portion in a longitudinal direction toward the front opening of the accessory connector body so as to be in spaced lateral alignment with the contact portion of the first terminal, and an attachment portion which is spaced from said contact portion in a transverse direction, and an insulated electrical accessory lead having an insulation stripped, exposed conductor at one end secured to the accessory terminal by the attachment portion, said accessory lead extending from the attachment portion in a longitudinal direction past said contact portion and out of the longitudinal cavity via the front opening.

* * * * *